United States Patent [19]

Mazzetti

[11] 4,124,334

[45] Nov. 7, 1978

[54] DIAPHRAGM PUMP

[76] Inventor: Flavio J. Mazzetti, 6580 Arequa Ridge La., Colorado Springs, Colo. 80919

[21] Appl. No.: 755,824

[22] Filed: Dec. 30, 1976

[51] Int. Cl.[2] ..... F04B 43/04; F01B 31/14; F04B 9/04; F04B 23/04

[52] U.S. Cl. ..... 417/480; 92/13.2; 92/13.7; 92/100; 417/539

[58] Field of Search ..... 417/413, 480, 539, 552; 92/13, 13.2, 13.7; 92/100, 98 R, 99

[56] References Cited

U.S. PATENT DOCUMENTS

| | | | |
|---|---|---|---|
| 122,475 | 1/1872 | McGowan | 417/552 X |
| 696,696 | 4/1902 | Runnells | 417/480 |
| 1,296,503 | 3/1919 | Gorman, Jr. | 417/480 |
| 1,376,574 | 5/1921 | Piercy | 417/480 X |
| 1,791,615 | 2/1931 | Dorr | 417/480 |
| 2,240,371 | 4/1941 | Linch et al. | 92/13.2 |
| 3,363,580 | 1/1968 | Logue | 417/480 |
| 3,776,107 | 12/1973 | Molus | 92/99 |

FOREIGN PATENT DOCUMENTS

| | | | |
|---|---|---|---|
| 921,495 | 11/1954 | Fed. Rep. of Germany | 417/413 |

*Primary Examiner*—Carlton R. Croyle
*Assistant Examiner*—Leonard E. Smith
*Attorney, Agent, or Firm*—Richard W. Hanes

[57] ABSTRACT

The invention involves an improved design for a diaphragm pump. The inlet and outlet valves for the pump have guided stems that prevent the valves from misaligning and jamming during operation. The stems extend away from each other enabling the valve heads to be moved close to each other so that the pump bowl can be made relatively short. The pump diaphragms include rim portions that cover and protect the members securing it in the pump. The stroke of the pump is adjustable by an arrangement that can vary the size of the stroke while keeping the suction and discharge portions of the stroke equal.

5 Claims, 11 Drawing Figures

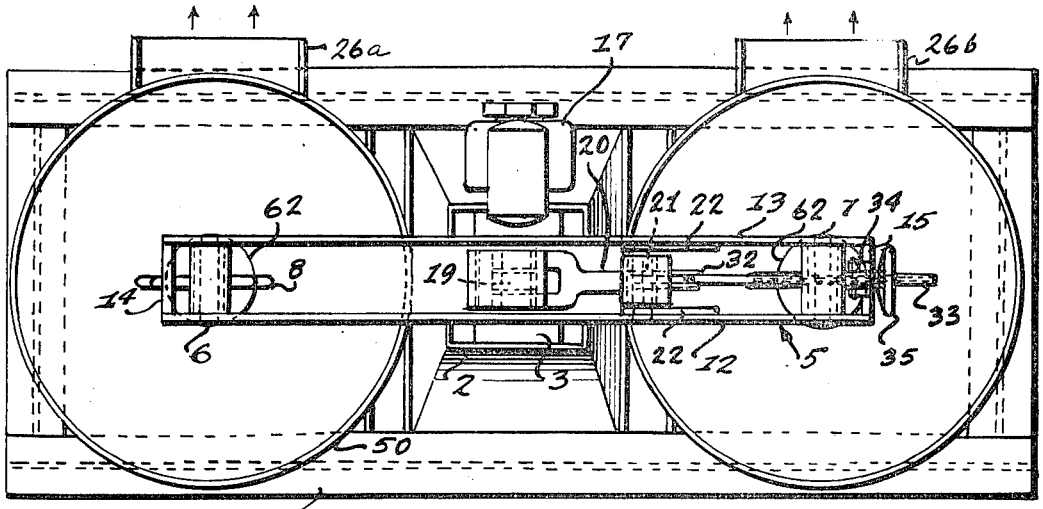
Fig. 2
Fig. 1
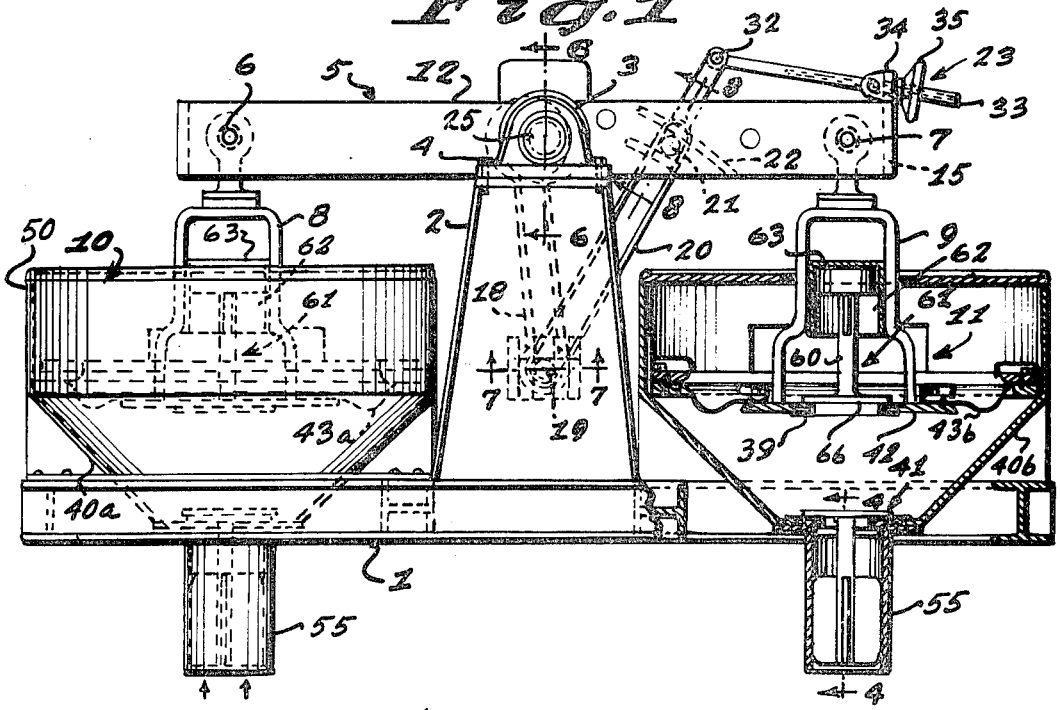
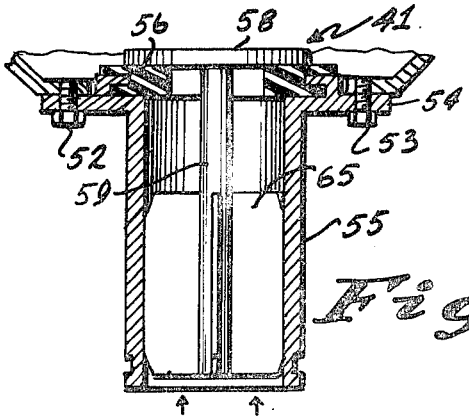
Fig. 4
Fig. 7
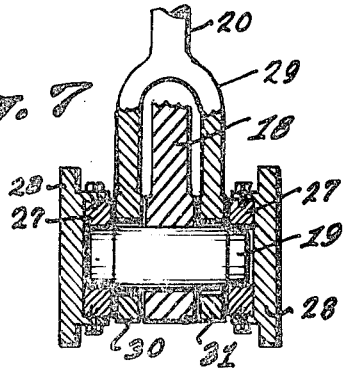

Fig. 3
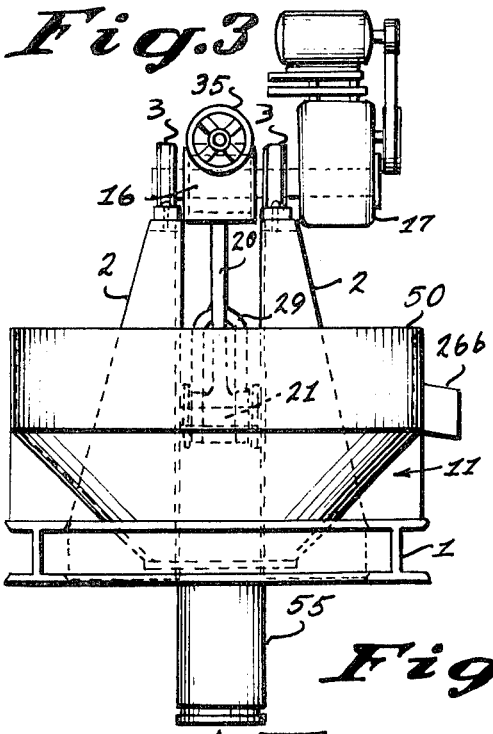
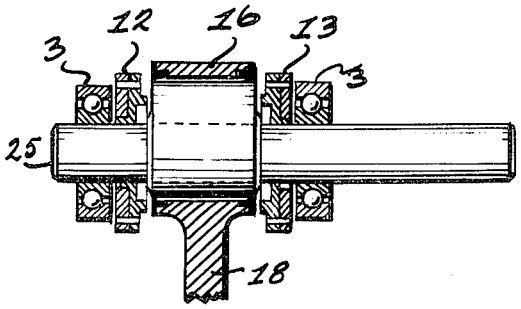
Fig. 6
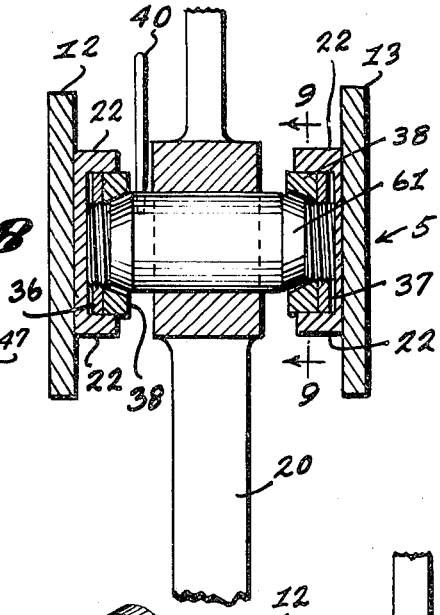
Fig. 8
Fig. 10
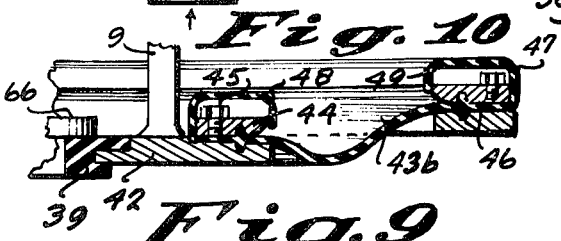
Fig. 9
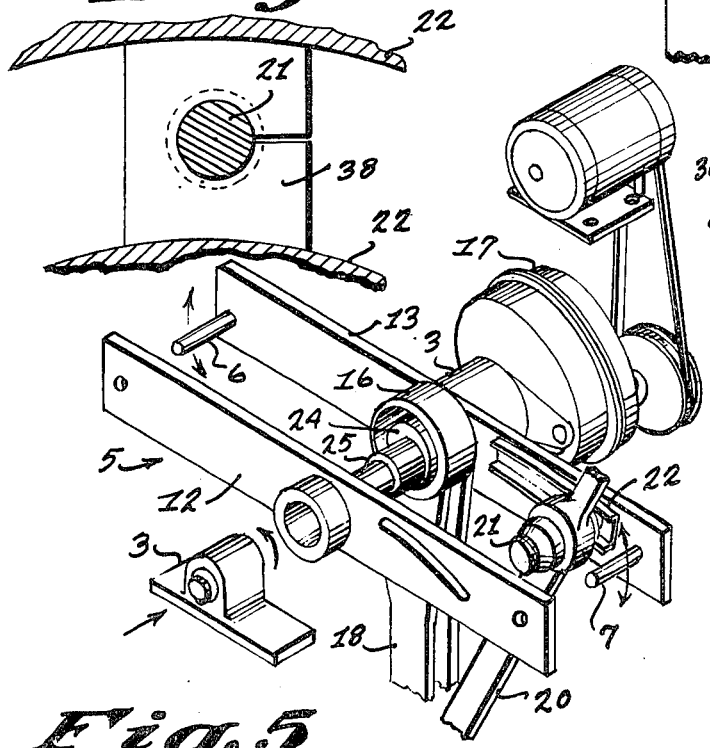
Fig. 5
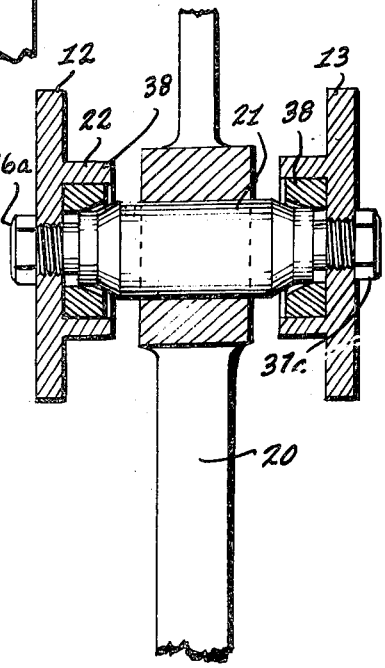
Fig. 11

DIAPHRAGM PUMP

BACKGROUND OF THE INVENTION

Diaphragm pumps are widely used in industry to perform small jobs in which a regulated and controlled flow is desired. For larger jobs involving 8 or 10 inch pipes, diaphragm pumps are usually replaced by centrifugal pumps. Although diaphragm pumps have superior flow control and regulation capabilities, centrifugal pumps have been found to be more reliable in performing the larger jobs.

Past diaphragm pumps have had design problems that have resulted in undesirable stresses, deflections, and misalignments in the working parts. These designs have also made is difficult to inspect and replace the parts. In smaller, cheaper diaphragm pumps, these design problems do not adversely affect the economic operation of the pump. In larger pumps, these design problems are aggravated and intensified to the point that frequency breakdowns and failures occur, making them economically inferior to centrifugal pumps.

Another problem encountered by both large and small diaphragm pumps is in the handling of corrosive and abrasive fluids. These fluids erode all exposed members securing the diaphragm in the pump. Previous designs have not been able to overcome this problem.

OBJECTS OF THE INVENTION

It is an object of this invention to provide a diaphragm pump with a reliable design that also permits easy access to all the working parts for quick inspection and replacement. The design of the pump permits most of the parts to be seen and reached from above. The valve design of the pump aligns the valves in a superior manner to prevent jamming during operation. The valve design also permits the use of a relatively short pump bowl.

It is an object to provide a diaphragm pump adaptable for use with large diameter pipes handling corrosive fluids and fluids with fine solids in suspension. The diaphragm is designed to cover the members securing it in place to protect them from the eroding forces of the fluid being handled.

It is an object to provide a pump with a main drive member and rocker frame that are moved about the same axis for continuous and long lasting alignment.

It is also an object to provide a diaphragm pump design that is adaptable for use in very large pumps.

It is also an object to provide a diaphragm pump with a stroke adjusting assembly. In diaphragm pumps, the suction and discharge portions of each stroke are preferably equal for best results. The stroke adjusting assembly of the instant invention cooperates with a pin and arcuate guide assembly to change the size of the stroke without affecting the equality of the suction and discharge portions.

BRIEF DESCRIPTION OF THE DRAWINGS

FIG. 1 is a side view of the twin pumping arrangement of the invention with one pumping element shown in cross section to illustrate its internal members.

FIG. 2 is a top view of the diaphragm pump of the present invention.

FIG. 3 is an end view of the pump showing part of the drive arrangement and illustrating the placement of the discharge outlet in the wall above the pump bowl.

The yoke of the pumping element is not shown in the view in order to better illustrate the drive arrangement.

FIG. 4 is a fragmentary cross-sectional view of the removable, lower valve arrangement of the pump.

FIG. 5 is a perspective view of the drive and stroke adjusting assembly of the pump.

FIG. 6 is a cross-sectional view taken along line 6—6 of FIG. 1, showing the eccentric drive cam and the top annular pin end portion of the vertically driven connecting rod.

FIG. 7 is a fragmentary cross-sectional view taken along line 7—7 of FIG. 1 showing the arrangement by which the movement of the connecting rod driven by the eccentric drive cam of FIG. 6 is transmitted to the bifurcated connecting rod.

FIG. 8 is a cross-sectional view taken along line 8—8 of FIG. 1 showing the manner in which the pin and arcuate guide assembly selectively secures the connecting rod to the rocker frame.

FIG. 9 is a view taken along line 9—9 of FIG. 8 illustrating the split bushing and arcuate guide members of the assembly.

FIG. 10 is a cross-sectional view illustrating the manner in which the diaphragm is secured at its inner and outer diameters to the reciprocating element of the pump and to the pump bowl. The diaphragm has rim portions at its inner and outer diameters that cover and protect the securing members.

FIG. 11 is a view of the modified pin and arcuate guide assembly for selectively securing the connecting rod to the rocker frame.

DETAILED DESCRIPTION OF THE INVENTION

The diaphragm pump of the present invention may contain either one or two pumping chambers. The preferred form of the invention comprises a frame 1 upon which are mounted two spaced apart pumping chambers 10 and 11. Intermediate the pumping chambers is located an upright support member 2 which carries the pump drive assembly, comprising the motor driven drive means 17 and a rocker arm assembly 5. The rocker arm, comprising parallel spaced apart side members 12 and 13, is pivotally mounted on a shaft 25 journalled in a pair of bearings 3. Attached to each end of the rocker arm 5, through pins 6 and 7 respectively, are means establishing a connection with pump diaphragms **43*a* and 43*b*, the latter of which are disposed transversely across each of the pumping chambers 10 and 11. The inlet to each of the pumping chambers is located at the bottom of the apex defined by the sloping sides 40*a* and 40*b* of each of the pumping chambers and is controlled by a valve assembly 41. The discharge ports 26*a* and 26*b* for each of the pumping chambers are located in the vertical side walls 50** of each of the pumping chambers at a position above the transversely disposed diaphragms.

During operation, the motor driven drive means 17 produces an oscillating rocking motion of the rocker arm 5 which is translated to reciprocal motion of the yokes 8 and 9 attached to the diaphragms **43*a* and 43*b* respectively. When the diaphragm 43*a* is at the height of the intake stroke, the diaphragm 43*b*** will be at the bottom of the pump stroke and vice versa.

The points of novelty in the present invention involve the mechanism for regulating the stroke of the pump and the mechanism for placing the inlet and discharge valves so as to effectively utilize the flexibility which is derived from the stroke adjustment features. These aspects of the invention will be described in more detail.

The stroke adjustment is achieved by a mechanism through which the force application moment arm can be changed. It will be seen by an examination of FIG. 1 that the rocker arm assembly 5 is fundamentally a third class lever, insofar as the pump chamber 40*b* is concerned, where the fulcrum is the center of rotation of the mounting spindle 25, the point of force application is the point where the drive pin 21 is confined within opposed arcuate guide members 22 on the rocker arm, and the lifting point is the pin 7 located near the extreme end of the rocker arm. With respect to the pumping chamber 40*a*, the rocker arm assembly 5 is essentially a first class lever where the point of force application (drive pin 21) is outside the arm defined by the distance between the fulcrum point 25 and the pin connection 6 located at the other end of the rocker arm 5. If the extent of the vertical component of the motion of the drive pin 21 remains constant, the extent of the vertical motion of the coupling pins 6 and 7 will be varied as a function of the distance between the fulcrum point 25 and the drive pin 21.

The adjustment of this force arm distance is made with the threaded screw adjustment assembly 23. The adjustment assembly comprises a threaded lead screw 33 attached at one of its ends by a pin connection 32 to an upward extension of the drive pin connecting rod 20. Near its other end, the lead screw 33 threadingly engages a rotatable hand wheel which rotates within a bearing block 34 rigidly mounted on an end plate 15 of the rocker arm 5. Rotation of the hand wheel 35 causes the lead screw to advance or retreat to pivot the drive pin connecting rod 20 about its center of rotation, a pin 19. Such lead screw adjustment and consequent pivotal motion of the connecting rod 20 causes the drive pin 21 to assume a new position within the confines of the arcuate guide members 22 which are rigidly mounted on the interior walls of the rocker arm side plates 12 and 13.

FIGS. 8 and 11 illustrate in more detail the relationship between the drive pin 21 and the rocker arm 5. In the preferred embodiment of FIG. 8, the drive pin 21 is rotatably mounted in an enlarged portion of the connecting rod 20. The projecting ends of the drive pin 21 rotatingly engage a pair of nuts 36 and 37 which are secured against rotation by the arcuate guide members 22 between the sides of which the nuts are disposed. Inwardly of the nuts 36 and 37 are a pair of split bushings 38 which surround a tapered portion of the drive pin. The bushings 38 are also confined between the side flanges of the arcuate guide members 22. When it is desired to loosen the driving connection between the connecting rod 20 and the rocker arm 5, the drive pin 21 is rotated by a handle 39 in such a direction that the nuts 36 and 37 are moved outwardly, allowing the split bushing 38 to expand and move down the tapered portion of the pin, all of which decreases the locking action. Rotation of the pin in the opposite direction causes the nuts 36 and 37 to travel inwardly, forcing the split bushing inwardly to ride up on the taper, causing a binding and locking action between the bushing and the flanged portion of the arcuate guide members 22.

The second embodiment of FIG. 11 places the nuts 36*a* and 37*a* outside of the sides 12 and 13 of the rocker arm 5. In order to lock the connecting rod 20 in position, the nuts 36*a* and 37*a* are rotated to cause compression of the side members 12 and 13 in order to force the bushings 38 into a wedging position along the taper of the drive pin 21. FIG. 9 illustrates the nature of the split bushing 38 with respect to the arcuate guide members 22 and the drive pin 21.

Reciprocating motion of the drive pin 21 is achieved through the connecting rod 20 which is pivotally connected by a pin 19 to a primary connecting rod 18. The primary connecting rod 18 is provided with two pin ends, the lower one of which carries a pin 19, which pin is also journalled for rotation in the bifurcated yoke 29 at the lower end of the drive pin connecting rod 20. Details of this arrangement are seen most clearly in FIG. 7 where it will be seen that the pin 19 is provided with projecting ends which are constrained within the channels defined by a pair of spaced apart guide blocks 27 attached to mounting brackets 28 which are in turn secured to the upright mounting platform 2. The constraint provided by the channel blocks 27 limits the connecting pin 19 to movement within a vertical plane.

Reciprocating movement of the primary connecting rod 18 is achieved through the use of an eccentric cam 24 which rotates within the cylindrical opening of the pin end 16 at the upper end of the connecting rod 18. The cam 24 is rigidly secured to the main drive shaft 25 for rotation therewith. The drive shaft 25 is operatively connected to a gear reducer and conventional drive train 17 which may be powered by any conventional motor device.

Each of the pumping chambers 10 and 11 comprises an inverted truncated cone whose shortened apexes form the bottom portion of the pumping assembly and whose divergent portion is extended upwardly with vertical walls covered by a top. At the juncture of the conical section and the vertical section of each of the pumping chambers there is attached interiorly thereof a set of annular clamping rings 46. Each pair of the clamping rings is secured to the inside of its respective pumping chamber and is positioned and disposed to clamp therebetween the outer edge of an annular elastic diaphragm (43*b*, for example). The inside edge of the elastic diaphragm is secured between the bottom plate 42 of the pumping yoke 9 and an upper clamping ring 44. Details of the diaphragm mounting are seen most clearly in FIG. 10. An examination of FIG. 10 will also reveal an additional feature of the present invention which is achieved by constructing the diaphragm mounting arrangement in such a way that the outer edges 48 and 49 of the diaphragm 43*b* are curled over the top annular clamping ring to cover the ring and the bolts 45 and 47 which secure the rings. Such an arrangement protects the bolts and clamping ring from the normally high wear to which similar clamping arrangements are subjected, especially in the presence of highly abrasive liquids with suspended solids. The protection which is achieved by the curled edge portion of the diaphragm may be obtained with the use of separate pieces.

Each of the pumping yokes 8 and 9 and the intake and discharge valve assemblies in the two pumps are the same. The description will be related to the apparatus of the pumping chamber referred to by reference number 11. The pumping yoke 9 comprises a pair of bifurcated legs which are secured at their upper ends to the rocker arm pin 7 and carry, at their lower ends, an annular valve seat plate 42. The edge of the center opening of the valve seat plate 42 is provided with an elastic ring 39 which acts as the valve seat to receive the head 66 of a valve 61. The recriprocably moveable valve 61 comprises a valve stem 60 attached to the valve head 66 and includes a plurality of radially projecting fins 62 mounted on the valve stem. The fins 62 are sized and positioned to slidingly engage the inside surface of a valve-containing cylinder 63 which is mounted between the legs of the yoke 9. The valve mounting cylinder 63 provides stability and control to the valve limiting it to vertical movement. As the pumping yoke 9 is pushed downwardly by the rocker arm 5, fluid within the pumping chamber 11 and beneath the diaphragm **43*b* forces the valve 61 to raise off of the valve seat 39 and admit fluid into the discharge section of the pump above the diaphragm. When the pumping yoke 9 is raised during the intake stroke, the valve 61 is caused to close against the valve seat 39 and the fluid above the diaphragm 43*b* is forced out of the discharge opening 26*b*. During the intake stroke of the pumping yoke 9 and at the time the diaphragm 43*b* is being lifted, the decreased pressure beneath the diaphragm causes the valve, generally described by reference number 41, to open and allow the admission of fluid through the intake port defined by the cylindrical valve chamber 55. Similarly to the valve assembly 61, the valve 41 comprises a valve stem 59 to which is attached a valve head 58 which abuts a valve seat 56. The valve seat 56 is preferably an elastomer ring mounted in the opening at the truncated apex of the pumping chamber 40*b*. The valve 41 is also provided with a plurality of radially extending fins 65 carried by the valve stem 59, which fins guide the movement of the valve stem within the valve chamber 55. For convenience and ease of maintaining the pump, the valve chamber 55 is attached to the underside of the pumping chamber by bolts 52 and 53**.

I claim:

1. In a double acting diaphragm pump, a pair of side by side chamber housings, each having an inlet and an outlet;

an annular pumping diaphragm disposed transversly across each of the housings between the inlet and outlet and dividing said housing into a suction chamber on the one side thereof and a discharge chamber on the other side;

first and second one-way valve means, the first being disposed in the housing inlet to admit fluid to the suction chamber, the second being disposed within the central opening of the annular pumping diaphragm and secured thereto to pass fluid from the suction chamber to the discharge chamber; and reciprocably operable drive means attached to the diaphragm of each chamber housing wherein the drive means includes:

a rocker arm pivotally mounted for oscillatory motion about an axis which is disposed intermediate the centers of the diaphragms in the chamber housings, connecting means secured to each of the said diaphragms and pivotally connected to the rocker arm;

eccentric means substantially coaxial with the axis of rotation of the rocker arm and having attached thereto and extending therefrom first and second pivotally interconnected drive arm; and a movable interconnection between the second one of said drive arms and the rocker arm to impart oscillatory motion to the rocker arm.

2. The double acting pump of claim 1 wherein the said movable interconnection comprises:

a pair of arcuate guide rails integral with the rocker arm, and a pin normal to the length of said second drive arm and attached thereto intermediate the ends thereof and positioned between the guide rails.

3. The combination of claim 2 and further including variable length means interconnecting the end of the said second drive arm and one end of the rocker arm.

4. The double acting pump of claim 1 and further including within each of the chamber housings:

a pair of cooperating clamping rings, means attaching one of said rings to the interior of the chamber housing;

fastening means interconnecting the said two rings whereby the diaphragm is clamped between the two rings radially inwardly of the outer periphery of the diaphragm leaving an outer edge thereof to fold inwardly as to protecting cover for said fasteners.

5. The combination of claim 4 where the connecting means secured to each of the diaphragms includes:

a valve cage for said second one-way valve means;

an annular seat ring attached to the end of the said cage which is proximal to the diaphragm, the inside edge of said annular seat ring having valve seat means and the outside edge of said ring having clamping means for securing the inside edge of the diaphragm thereto.

* * * * *